US005123895A

United States Patent [19]

Mandel

[11] Patent Number: 5,123,895

[45] Date of Patent: Jun. 23, 1992

[54] PASSIVE, INTELLIGENT, SHEET DECURLING SYSTEM

[75] Inventor: Barry P. Mandel, Fairport, N.Y.

[73] Assignee: Xerox Corporation, Stamford, Conn.

[21] Appl. No.: 402,748

[22] Filed: Sep. 5, 1989

[51] Int. Cl.[5] ..... B41F 25/00; B65H 23/34

[52] U.S. Cl. ..... 493/459; 493/461; 162/271

[58] Field of Search ..... 493/320, 459, 460, 461; 162/270, 271

[56] References Cited

U.S. PATENT DOCUMENTS 4,077,519 3/1978 Huber ..... 209/74
4,326,915 4/1982 Mutschler, Jr. ..... 162/271
4,360,356 11/1982 Hall ..... 493/459
4,475,896 10/1984 Bains ..... 493/454
4,505,695 3/1985 Billings ..... 493/459
4,591,259 5/1986 Kuo et al. ..... 355/3
4,632,533 12/1986 Young ..... 355/3

*Primary Examiner*—William E. Terrell
*Attorney, Agent, or Firm*—William A. Henry, II

[57] ABSTRACT

An apparatus in which sheet material is decurled. The apparatus includes a baffle type decurler in which a sheet moving therethrough chooses one of three paths and baffles, depending on the direction and amount of curl. Triangular shaped baffles prevent sheet stubbing and a decurling system reverse bends the sheets in two of the three paths.

3 Claims, 3 Drawing Sheets 10
12
14
16
18
20
22
24
26
28
30
32
34
36
38
40
42
44
46
48
50
52
54
56
58
60
61
62
63
64
66
68
80
A
B
C
D
E
F

PASSIVE, INTELLIGENT, SHEET DECURLING SYSTEM

This invention relates generally to an electrophotographic printing machine, and more particularly concerns an apparatus for decurling sheet material employed therein.

Generally, electrophotographic printing comprises charging a photoconductive member to a substantially uniform potential so as to sensitize the surface thereof. The charged portion of the photoconductive surface is exposed to a light image of the original document being reproduced. This records an electrostatic latent image on the photoconductive member which corresponds to the informational areas contained within the original document. The latent image is developed by bringing a developer material into contact therewith. In this way, a powder image is formed on the photoconductive member which is subsequently transferred to a sheet of support material. The sheet of support material is then heated to permanently affix the powder image thereto.

As the sheet of support material passes through the various processing stations in the electrophotographic printing machine, a curl or bend is frequently induced therein. Occasionally, this curl or bend may be inherent in the sheet of support material due to the method of manufacture thereof. It has been found that this curl is variable from sheet to sheet within the stack of sheets utilized in the printing machine. The curling of the sheet of support material causes problems of handling as the sheet is processed in the printing machine. Sheets delivered in a curled condition have a tendency to have their edges out of registration with the aligning mechanisms employed in the printing machine. In addition, curled sheets tend to frequently produce jams or misfeeds within the printing machine, or in downstream subsystems, especially output stacking and compiling systems. In the past, this problem has been resolved by utilizing bars, rollers or cylinders which engage the sheet material as it passes through the printing machine. Frequently, belts or soft rollers are used in conjunction with a hard penetrating roll to remove the curl in a sheet. Also, a conventional decurler, which most often is of the belt/pinch roll type, has a single paper path. Although multiple bending can be set along the paper path, the single path is only effective in reducing paper curls that are primarily in one direction; it is not effective in reducing large curl in the other direction. In other words, if a conventional decurler is designed for flattening dominant Tl (toward image) curls, it would not be able to reduce large Al (away image) curls significantly, and vice versa. For this reason, a single path decurler would fail to decurl thin papers as they exhibit both strong Al and Tl curls (depending on which side is on the hot fuser roll) at high moisture content.

Various approaches have been devised to improve sheet decurlers to answer the above-detailed problems. The following disclosures appear relevant: U.S. Pat. No. 4,077,519; Patentee: Huber; issued Mar. 7, 1978. U.S. Pat. No. 4,326,915; Patentee: Mutschler, Jr.; issued Apr. 27, 1982. U.S. Pat. No. 4,360,356; Patentee: Hall; issued Nov. 23, 1982. U.S. Pat. No. 4,475,896; Patentee: Bains; issued Oct. 9, 1984. U.S. Pat. No. 4,505,695; Patentee: Billings issued May 19, 1985. U.S. Pat. No. 4,591.259; Patentee: Kou et al, issued May 27, 1986. U.S. Pat. No. 4,632,533; Patentee: Young issued Dec. 30, 1986.

The pertinent portions of the foregoing disclosures may be summarized as follows:

Huber describes a curl detector and separator wherein a paper sheet is passed through the nip of a rotating roll and charging roll, and thereafter the sheet is stripped from the rotating roll by a vacuum stripper which allows the sheet to pass between the nip of a subsequent transport roll pair.

Mutschler, Jr. discloses a sheet decurler apparatus wherein a sheet is pressed into contact with a rigid arcuate member in at least two regions. The sheet moves about the arcuate member or rod in a curved path to remove curl in the sheet. The sheet is bent in one direction by a first rod and in another direction by a second rod.

Hall discloses an apparatus for removing curl from continuous web material during its travel through engagement bars that can be adjusted to remove Al or Tl curl.

Baines describes a curling/decurling mechanism that combines a compliant roller with a soft outer layer in a curling roller to form a penetration nip with the compliant roller. Movable plates are employed to control the angle of sheets as they exit from the nip.

Billings discloses a sheet decurling mechanism which uses a roller to over curl a sheet before it enters a decurler. Two paths are provided for a sheet to go along depending upon the amount of curl the sheet has after it has passed the overcurl roller. A belt structure is used to curl a sheet within the decurler.

Kou et al. is directed to the tri-pass baffle decurler in which a sheet moving therethrough chooses one of the three paths and baffle surfaces depending on the direction and amount of curl. Spring loaded baffles are included that work in conjunction with idler rolls in order to apply reverse bends in sheets transported through two of the three paths.

Young discloses an off-set nip roll decurler which uses a surface to guide a sheet through one of two possible paths. A means is provided to curl a sheet using a drive roller structure and an idler roller structure which is spring loaded to provide an appropriate amount of curl.

In accordance with the features of the present invention, there is provided a tri-pass baffle decurler apparatus that decurls multiple weights of papers and is equally effective in reducing Tl and Al image curls. The apparatus includes a plurality of baffles that guide sheets leaving a fuser into either of three paths depending on the direction and amount of curl induced into the sheets by the fuser. Sheets having Tl curls are led into a first path defined by a first baffle and partition member and sheets having Al curls are led into a second path by a second baffle and partition member. Flat sheets are led between said first and second partition members in a third straight through path. The improved baffles are configured so as to minimize stubbing of sheets entering the decurler.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
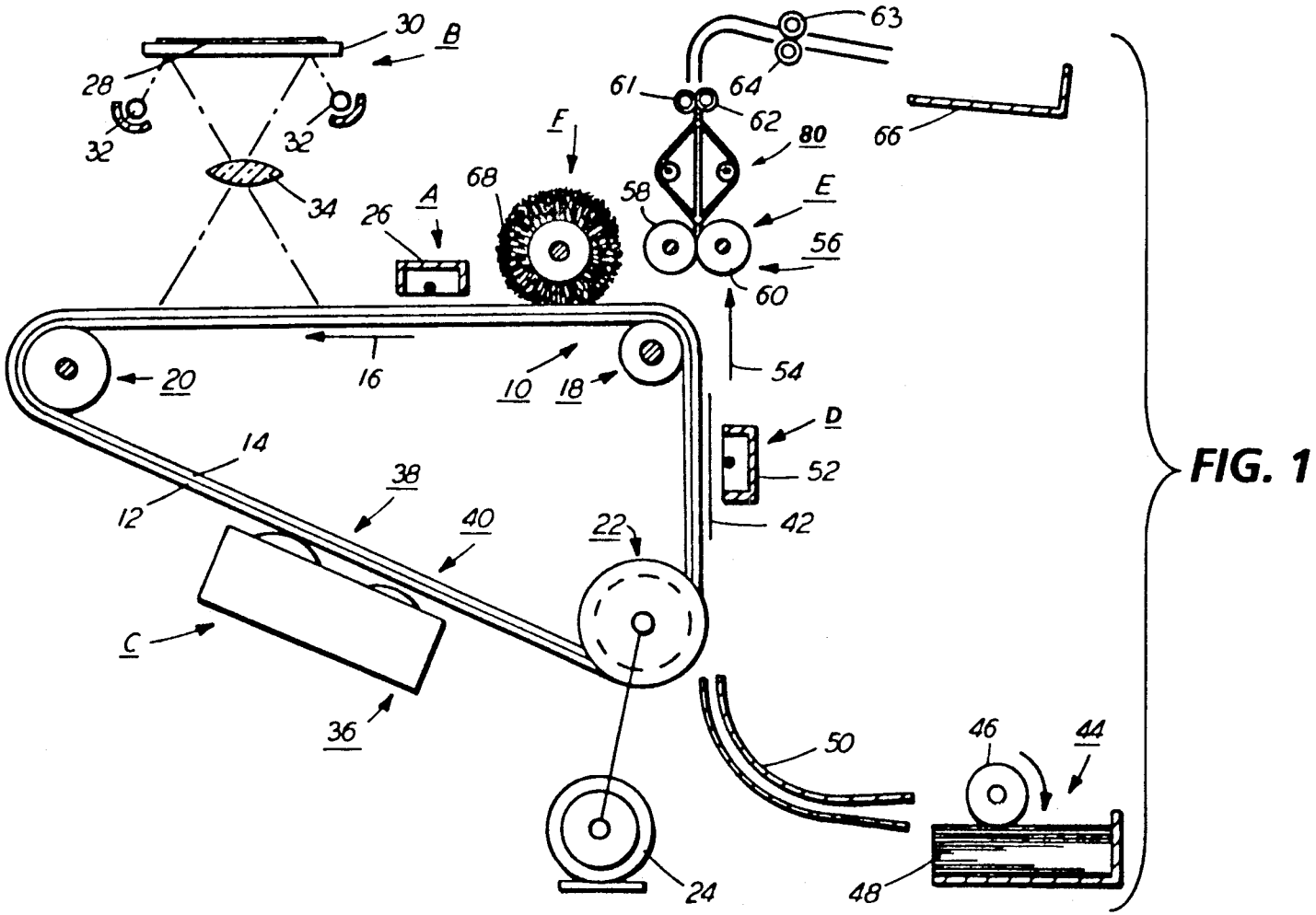
FIG. 1 is an elevational view illustrating schematically an electrophotographic printing machine incorporating the features of the present invention therein.

For a general understanding of the features of the present invention, reference is made to the drawings. In the drawings like reference numerals have been used throughout to designate identical elements. FIG. 1 schematically depicts the various components of an illustrative electrophotographic printing machine incorporating the improved decurling apparatus of the present invention therein. It will become evident from the following discussion that the decurling apparatus is equally well suited for use in a wide variety of printing machines and is not necessarily limited in its application to the particular embodiment shown herein. In addition, the location of the decurling apparatus, as depicted in the FIG. 1 electrophotographic printing machine, may be varied. The decurling apparatus may be positioned intermediate any of the processing stations within the printing machine. In the printing machine depicted in FIG. 1, the decurling apparatus is positioned after the fusing station prior to the catch tray so as to straighten the final copy sheet prior to removal from the printing machine by the operator. However, this location is merely illustrative of the operation of the decurling apparatus and may be varied. For example, the catch tray could be replaced with a compiler tray or finisher apparatus.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface 12 deposited on a conductive substrate 14. Preferably, photoconductive surface 12 comprises a transport layer having small molecules of m-TBD dispersed in a polycarbonate and a generation layer of trigonal selenium. Conductive substrate 14 is made preferably from aluminized Mylar which is electrically grounded. Belt 10 moves in the direction of arrow 16 to advance successive portions of photoconductive surface 12 through the various processing stations disposed about the path of movement thereof. Belt 10 is entrained about stripping roller 18, tension roller 20, and drive roller 22. Drive roller 22 is mounted rotatably and in engagement with belt 10. Roller 22 is coupled to motor 24 by suitable means such as a belt drive. Motor 24 rotates roller 22 to advance belt 10 in the direction of arrow 16. Drive roller 22 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 1, initially a portion of belt 10 passes through charging station A. At charging station A, a corona generating device, indicated generally by the reference numeral 26, charges photoconductive surface 12 to a relatively high, substantially uniform potential.

Thereafter, the charged portion of the photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28.

Next, belt 10 advances the electrostatic latent image recorded on photoconductive surface 12 to development station C. At development station C, a magnetic brush development system, indicated generally by the reference numeral 36, transports a developer material into contact with photoconductive surface 12. Preferably, the developer material comprises carrier granules having toner particles adhering triboelectrically thereto. Magnetic brush system 36 preferably includes two magnetic brush developer rollers 38 and 40. These developer rollers each advance the developer material into contact with the photoconductive surface 12. Each developer roller forms a chain-like array of developer material extending outwardly therefrom. The toner particles are attracted from the carrier granules to the electrostatic latent image forming a toner powder image on photoconductive surface 12 of belt 10.

Belt 10 then advances the toner powder image to transfer station D. At transfer station D, a sheet of support material 42 is moved into contact with the toner powder image. The sheet of support material is advanced to transfer station D by a sheet feeding apparatus 44. Preferably, the sheet feeding apparatus 44 includes a feed roll 46 contacting the uppermost sheet of stack 48. Feed roll 46 rotates to advance the uppermost sheet from stack 48 into chute 50. Chute 50 directs the advancing sheet of support material into contact with photoconductive surface 12 in registration with the toner powder image developed thereon. In this way, the toner powder image contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred toner powder image to sheet 42. Preferably, a fuser assembly 56 includes a heated fuser roller 58 and a back-up roller 60. Sheet 42 passes between fuser roller 58 and back-up roller 60 with the toner powder image contacting fuser roller 58.

In this manner, the toner powder image is heated so as to be permanently affixed to sheet 42. After fusing a sheet 42 is guided to the decurling apparatus, indicated generally by the reference numeral 80. At this time, the sheet of support material has undergone numerous processes and very frequently contains undesired curls therein. This may be due to the various processes through which it has been subjected, or to the inherent nature of the sheet material itself. Decurling apparatus 80 bends the sheet of support material so that the sheet material is strained to exhibit plastic characteristics. After passing through decurling apparatus 80, the sheet of support material is advanced into catch tray 66 for subsequent removal from the printing machine by the operator. It should be understood that catch tray 66 could be replaced with a finisher apparatus or compiling tray. The detailed structure of decurling apparatus will be described hereinafter with reference to FIGS. 2, 3 and 4.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fiberous brush 68 in contact with photoconductive surface 12. The pre-clean corona generating device neutralizes the charge attracting the particles to the photoconductive surface. The particles are then cleaned from photoconductive surface 12 by the rotation of brush 68 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient for purposes of the present application to illustrate the general operation of an electrophotographic printing machine incorporating the features of the present invention therein.

Figure 2:
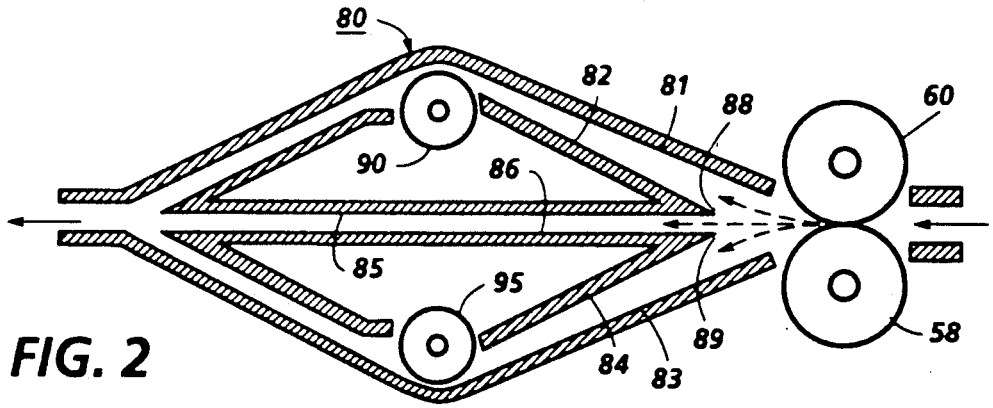
FIG. 2 is a 90° clockwise rotated elevational view showing the decurling apparatus of the present invention used in the printing machine of FIG. 1.

Referring now to the subject matter of the present invention, FIG. 2 depicts an embodiment 80 of the decurler apparatus of the present invention in detail. The decurling apparatus 80 features two paths for reverse bending Al (away from image) and Tl (toward image) curls (paper path self-determined by direction of paper curl) and one straight path for flatter papers. Decurler 80 requires no adjustment and is capable of reliably handling 13# paper through 110# papers with a wide latitude of moisture content. The decurler is cost effective because no belts or stepped rolls for belts are used as in conventional decurlers. As heretofore mentioned, a conventional decurler has a single path and uses multiple bends along the path to accomplish decurling. However, the single path is effective in removing curl in only one direction. In order to overcome this limitation, the decurler apparatus 80 incorporates three paper paths. These paper paths take advantage of the fact that fused papers already show clear Tl or Al curl tendency in a short distance (about 0.5 inches) from the fuser nip. Capitalizing on the well developed curl direction, pointed edged baffles 84 and 82 are positioned to guide the lead edges of copy sheets into three paths. As shown in FIG. 2, sheets of any kind having Al curls are led into a first path defined by guide baffle 81 and position baffle 82 for reverse bending (Tl) by drive roll 90 in conjunction with guide baffle 81. Similarly, sheets having Al curls are guided for reverse bending (Al) in a second path defined by guide baffle 83 and partition baffle 84 that directs the sheets into drive roll 95 which in conjunction with baffle 83 decurls the sheets. Guide baffles 81 and 83 have end portions adjacent fuser 56 that serve as stripper fingers to insure that serially curled sheets do not continue around either rolls 58 or 60. Flatter sheets leave fuser 56 and are directed by inner surfaces of partition members 82 and 84 into an opening in the center of the decurler apparatus formed by flat surfaces 85 and 86 of the partitions, respectively. This straight through path directs sheets into transport take away rolls 61 and 62.

Figure 4:
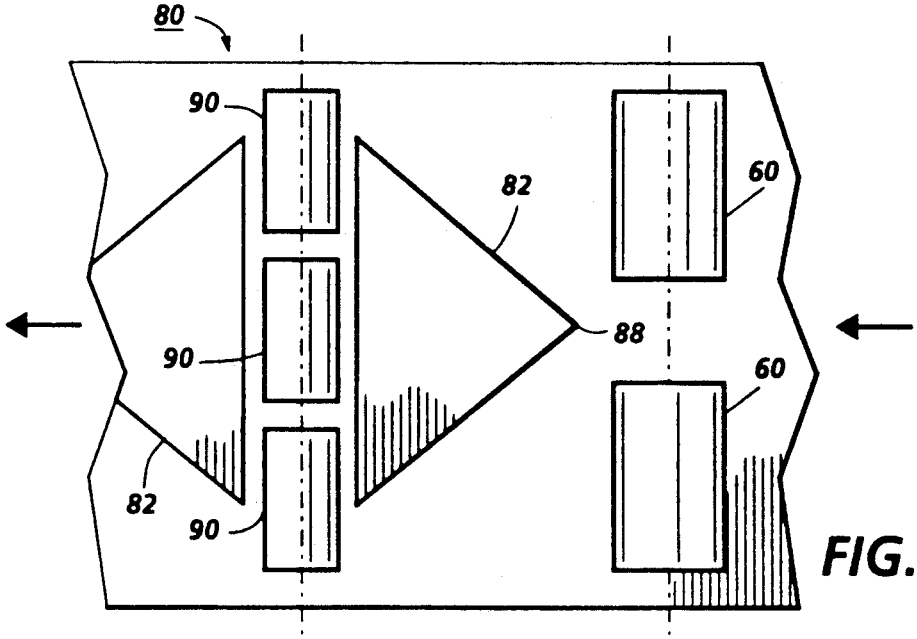
FIG. 4 is a partial plan view of the decurler apparatus of FIG. 2 showing the improved baffle design of the present invention.

Partition baffles 82 and 84 are shaped to points or apexes 88 and 89 in order to insure that copy sheets 42 do not stub on the baffles as the sheets leave fuser 56. In accordance with the present invention, as shown in FIG. 4, various baffle shapes are possible in order to prevent stubbing of the copy sheets on the partition baffles. For example, baffle 82 is shown configured as a triangle with two equal sides that form a point 88 extending upstream with respect to a horizontal plane and the copy sheet transport direction. Inclined separation baffle surface portion 82 and flat surface portion 85 of separation baffle 82 when viewed with respect to a vertical plane intersect to form a point 88 that meets incoming copy sheets. Stubbing of the copy sheets is prevented since initially all the incoming copy sheets contact is pointed surface 88 or pointed surface 89. Afterwards, the copy sheets are greeted by more of the triangular surface of baffle 82 with this gradual increase of surface area presented to each incoming sheet serving to prevent stubbing of the copy sheets on baffle 82. The sequence of operation is true for baffle 84 as well since both baffles are configured the same.

Figure 3:
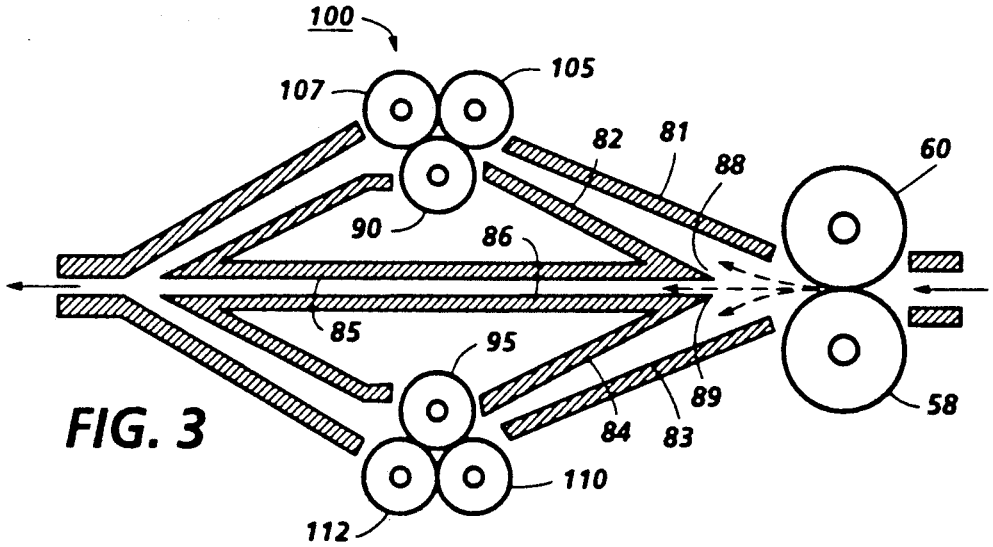
FIG. 3 is a 90° clockwise rotated alternative embodiment of the present invention that is usable in the printing machine of FIG. 1.
Figure 5:
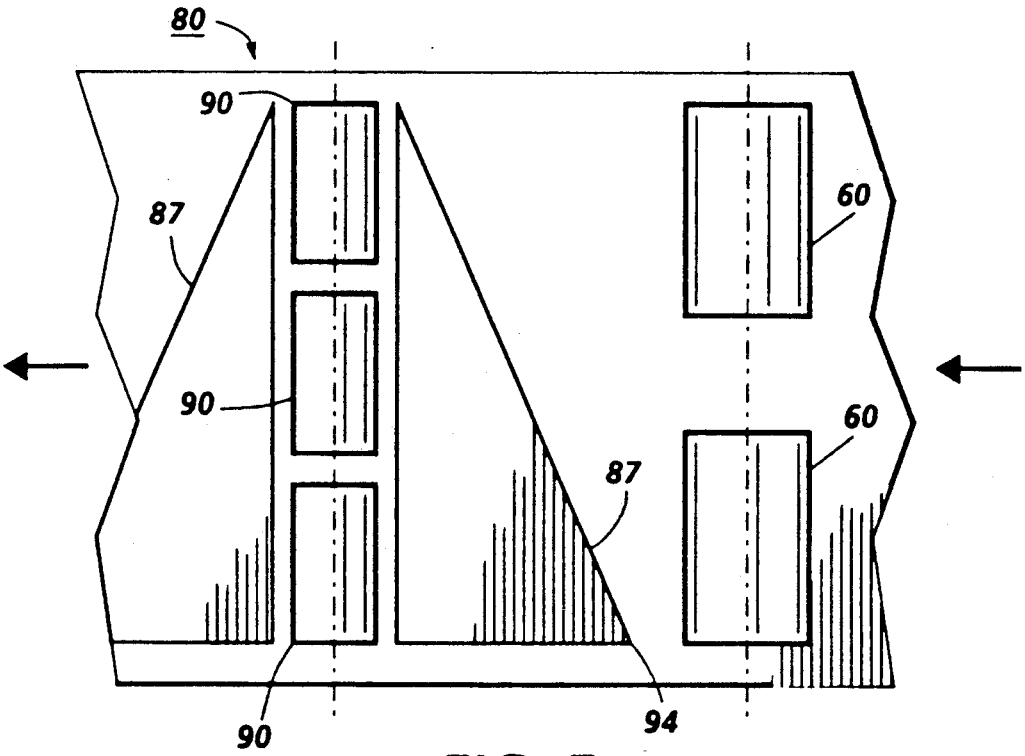
FIG. 5 is a partial plan view of the decurler apparatus of FIG. 2 showing an alternative separation baffle design of the present invention.

In FIG. 3, passive, intelligent decurling system 100 includes optional idler rolls 105, 107, 110 and 112. If desired, these additional rolls could be included at the decurling point of the decurler to cooperate with drive rolls 90 and 95, respectively, as an additional measure to insure proper decurling action. In FIG. 4, the decurler apparatus 80 is shown configured as a triangle 82 as viewed from a position orthogonal to the a horizontal plane and FIG. 5 shows a partial top view of an alternative separation baffle design of the present invention. With respect to FIG. 5, an alternative shape for the separation baffle in decurler 80 is shown as a right triangle 87. Here too, stubbing of copy sheets against the baffle is prevented, since point 94 of baffle 87 is the first portion of the baffle that the lead edge of copy sheets approaches as they leave fuser 56.

In recapitulation, it is apparent that a decurler apparatus has been disclosed in which a sheet chooses one of three paths and baffles depending on the amount and direction of the curl. The apparatus is designed such that an insignificantly curled sheet passes straight through a center path in the decurler undeflected. The baffles located in the other two sheet paths are configured to prevent copy sheets from stubbing thereagainst and to reverse bend a sheet deflected into either of the two paths for straightening of lightweight or thick sheets.

It is, therefore, evident that there has been provided, in accordance with the present invention and apparatus for decurling a sheet of support material being used in and electrophotographic printing machine. This apparatus fully satisfies the aims and advantages hereinbefore set forth. While this invention has been described in conjunction with a specific embodiment thereof, it is evident that any alternatives, modifications, and variations will be apparent to those skilled in the art. Accordingly, it is intended to embrace all such alternatives, modifications, and variations as fall within the spirit and scope of the appended claims.

I claim:

1. An apparatus for decurling sheet material, including:

first and second guide baffles for receiving sheets to be decurled;

first and second separation baffle means positioned within said first and second guide baffles and adapted to direct sheets received by said first and second separation baffles into one of three paths depending on the amount and direction of curl in the sheets, and wherein said first and second separation baffle means are configured with respect to a predetermined vertical plane such that surface portions of said separation baffle means slope away from said predetermined vertical plane and wherein, and said first and second baffle separation means are configured as triangles when viewed orthogonally with respect to a horizontal plane; and means for decurling the sheets directed thereinto by said first and second separation baffle means, and wherein said triangles have unequal sides with a connecting point of two of said unequal sides extending upstream from said decurling device.

2. A printing machine adapted to produce copies of page images on sheets fed through a plurality of processing stations in the machine including a fuser, the machine having a sheet decurling device for removing curl in the sheets after they have left the fuser, said sheet decurling device comprising: first and second guide baffles for receiving sheets to be decurled; and first and second separation baffle means positioned within said first and second guide baffles and adapted to direct sheets received by said first and second separation baffles means into one of three paths depending on the amount and direction of curl in the sheets, and wherein said first and second separation baffle means are configured with respect to a predetermined vertical plane such that surface portions of said separation baffle means slope away from said predetermined vertical plane and wherein said first and second separation baffle means are configured as triangles when viewed orthogonally with respect to a horizontal plane, and means for decurling the sheets directed thereinto through either of two of said three paths, and wherein said triangles have unequal sides with a connecting point of two of said unequal sides extending upstream from said decurling device.

3. In a printing machine adapted to produce copies of page images on sheets fed through a plurality of processing stations in the machine, the machine having a sheet decurling device for removing curl in the sheets being processed within the machine, the improvement of said decurling device, comprising: sheet stubbing prevention means for providing smooth entry of sheets into said decurling device and having a portion thereof tapering across the sheet feed direction to a point and extending upstream from said decurling device, and wherein said sheet stubbing prevention means comprises separation baffles configured with respect to a predetermined vertical plane such that surface portions of said separation baffles slope away from said predetermined vertical plane, and said separation baffles include first and second separation baffles configured as triangles when viewed orthogonally with respect to a horizontal plane, and wherein said triangles have unequal sides with a connecting point of two of said unequal sides extending upstream from said decurling device.

* * * * *